US006960742B2

(12) United States Patent
Wei

(10) Patent No.: US 6,960,742 B2
(45) Date of Patent: Nov. 1, 2005

(54) ELECTRICAL OVEN WITH DETACHABLE LINERS

(75) Inventor: Kun-lian Wei, Zhuhai (CN)

(73) Assignee: Wang Dong-lei, Zhuhai (CN)

( * ) Notice: Subject to any disclaimer, the term of this patent is extended or adjusted under 35 U.S.C. 154(b) by 0 days.

(21) Appl. No.: 10/817,717

(22) Filed: Apr. 2, 2004

(65) Prior Publication Data

US 2004/0238521 A1 Dec. 2, 2004

(30) Foreign Application Priority Data

May 26, 2003 (CN) ..... 03226522 U

(51) Int. Cl.[7] ..... F24C 15/16; A21B 1/50; A21B 3/00

(52) U.S. Cl. ..... 219/391; 219/402; 219/408; 126/39 M; 126/19 R; 126/333; 126/337 R

(58) Field of Search ..... 219/391, 402, 219/405–408; 126/190, 332, 333, 337 R, 339, 19 R, 22, 39 M

(56) References Cited

U.S. PATENT DOCUMENTS

| | | | | | |
|---|---|---|---|---|---|
| 2,222,065 | A | * | 11/1940 | Blakeslee | 126/337 R |
| 3,036,193 | A | * | 5/1962 | Allen, Jr. | 219/391 |
| 3,145,289 | A | * | 8/1964 | Swetlitz | 219/395 |
| 3,151,608 | A | * | 10/1964 | Hurko | 126/19 R |
| 3,153,408 | A | * | 10/1964 | Brillas | 126/39 M |
| 3,159,156 | A | * | 12/1964 | Incledon | 126/19 R |
| 3,344,779 | A | * | 10/1967 | Johnson | 126/19 R |
| 3,410,260 | A | * | 11/1968 | Morgan | 126/19 R |
| 3,706,302 | A | * | 12/1972 | Helgeson et al. | 126/19 R |
| 3,791,371 | A | * | 2/1974 | Oatley | 126/339 |
| 4,307,285 | A | * | 12/1981 | DeRemer | 219/392 |
| 5,878,738 | A | * | 3/1999 | Poirier | 126/19 R |
| 6,101,930 | A | * | 8/2000 | Van Over | 99/426 |
| 6,225,603 | B1 | * | 5/2001 | Wai | 219/391 |

FOREIGN PATENT DOCUMENTS

| | | | |
|---|---|---|---|
| EP | 0716269 | A1 | * 6/1996 |
| FR | 2636410 | A | * 3/1990 |
| GB | 2331357 | A | * 5/1999 |

* cited by examiner

*Primary Examiner*—Joseph Pelham
(74) *Attorney, Agent, or Firm*—Welsh & Katz, Ltd.

(57) ABSTRACT

This invention discloses an electric oven with detachable liners includes a front door, a control panel and a rear shell; inside the rear shell is an inner chamber where an electric heater and a baking rack are installed; wherein, said electric oven further includes at least one piece of detachable liners, each detachable liner is in the shape of plane plate and is detachably installed at the inner side of said inner chamber. By adding the detachable liners, the inner chamber of the electric oven can be always kept clean and new. Besides, it is convenient to put the detachable liners into conventional dish washing troughs or dish washing machines for soaking and cleaning. The present invention is widely applicable to conventional electric ovens by modification of the existing ovens and addition of the detachable liners.

3 Claims, 2 Drawing Sheets

ELECTRICAL OVEN WITH DETACHABLE LINERS

TECHNICAL FIELD

This invention relates to an electric oven, and more particular to the structure of an electric oven.

BACKGROUND OF THE INVENTION

An electric oven is a popular electric heating apparatus for baking food. A conventional electric oven includes a front door, a control panel and a rear shell. Inside the rear shell is an inner chamber where an electric heater and a baking rack are installed. Delicious food is prepared when it is placed on the baking rack and heated with the electric heater. However, it is bothersome for the users after the electric oven is used for some time, because the sludge accumulated on the inner chamber of the oven is very difficult to clean clearly, especially after it is used for baking greasy food. Even if the inner chamber is made of stainless steel or covered with non-stick coatings, the oven is not convenient to clean due to the obstruction of the inner parts secured to the inner chamber, such as the electric heater, etc. Therefore, it is easy to generate bacteria and peculiar smell after the oven is used for some time, which may depress the purchasing desire of some potential customers. To overcome the above mentioned shortcomings, someone designed an integral detachable inner assembly to be installed inside the electric oven. However, the electric heater had to be modified and installed on the back inner board of the oven, which increased the production cost and the whole volume of the oven. In the meantime, the integral detachable inner assembly is too large to be placed into the conventional dish washing troughs or dish washing machines, which brings inconvenience for soaking and washing.

SUMMARY OF THE INVENTION

The main object of the present invention is to provide an electric oven with detachable liners, so as to overcome the above mentioned shortcomings of the prior art.

The electric oven of the present invention includes a front door, a control panel and a rear shell; inside the rear shell is an inner chamber where an electric heater and a baking rack are installed; wherein, said electric oven further includes at least one piece of detachable liners, each detachable liner is in the shape of plane plate and is detachably installed at the inner side of said inner chamber.

Said detachable liners are made of stainless steel or covered with non-stick coatings.

Said detachable liners include left-side and right-side detachable liners. Said left-side and right-side detachable liners are installed respectively at the left and right inner side board of the electric oven by guiding means secured on the inner chamber of said electric oven. Said left-side and right-side detachable liners can be inserted into or extracted from said electric oven along said guiding means.

On said left-side and right-side detachable liners are further installed guiding means for supporting said baking rack. Said baking rack can be inserted into or extracted from said electric oven along said guiding means.

Said detachable liners include a lower detachable liner. Said lower detachable liner is pan shaped and installed on the bottom of the inner chamber of said electric oven. Said lower detacher liner is used as the residue collecting pan as well.

Said detachable liners include a back detachable liner. Said back detachable liner is installed at the inner side of the back board of the electric oven by guiding means secured on the inner chamber of said electric oven. There is an opening at the upper side of the back board of the electric oven for allowing said back detachable liner to be inserted into or extracted from said electric oven along said guiding means.

Said detachable liners include an upper detachable liner. For the electric oven without an upper electric heater, said upper detachable liner is installed at the inner side of the upper board of the electric oven by guiding means secured on the inner chamber of said electric oven, and can be inserted into or extracted from said electric oven along said guiding means. For the electric oven with an upper electric heater secured to the electric oven by porcelain seats, said upper detachable liner is installed directly on said porcelain seats.

Thanks to the above mentioned technical scheme, the electric oven of the present invention has following advantages:

1. Since the detachable liners can be extracted out of the electric oven for cleaning, the inner chamber of the electric oven can be always kept clean and new;
2. Since the detachable liners are in the form of plane plates, it is convenient to put them into conventional dish washing troughs or dish washing machines for soaking and cleaning;
3. The present invention is widely applicable to conventional electric ovens by modification of the existing ovens and addition of the detachable liners.

The present invention will be described in details with the accompanying drawings.

DETAILED DESCRIPTION OF THE PREFERRED EMBODIMENTS

Figure 1A:
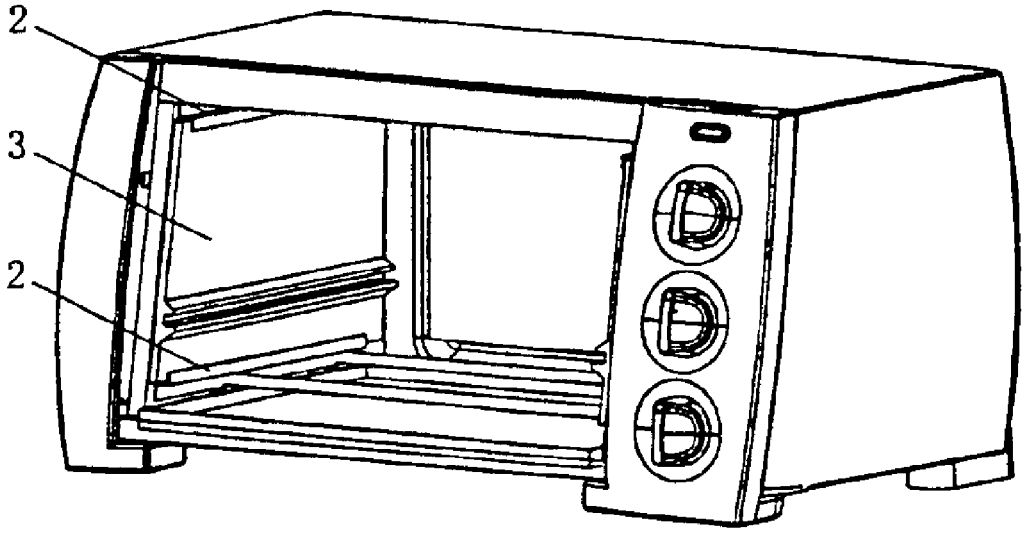
FIG. 1*a* is a schematic perspective view showing the working status of the electric oven of the present invention with the detachable liners installed (the glass door is omitted for better observation and illustration)
Figure 1B:
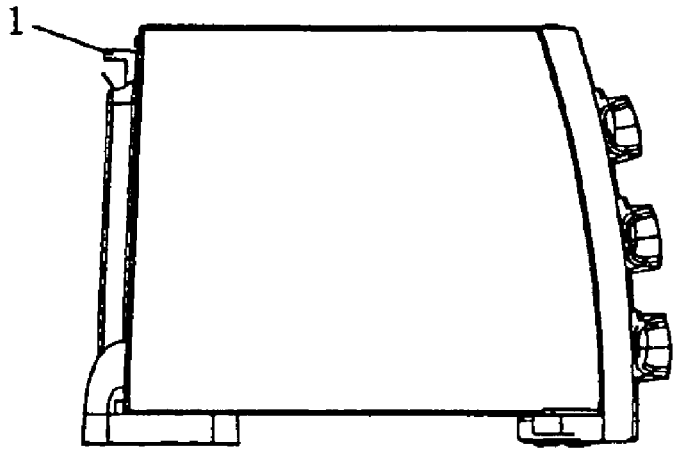
FIG. 1*b* is a side view of the electric oven shown in FIG. 1*a;*
Figure 2:
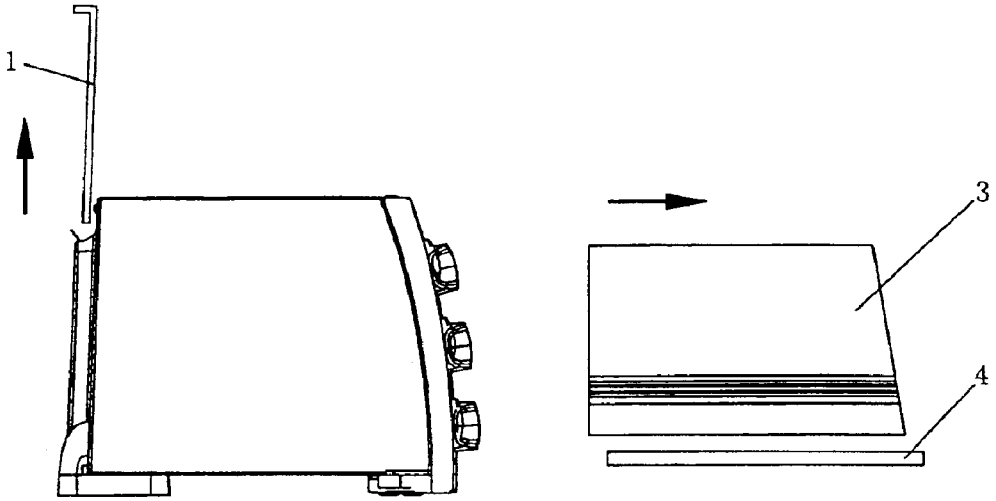
FIG. 2 is a schematic view showing the extraction of the detachable liners for the purpose of cleaning.
Figure 3:
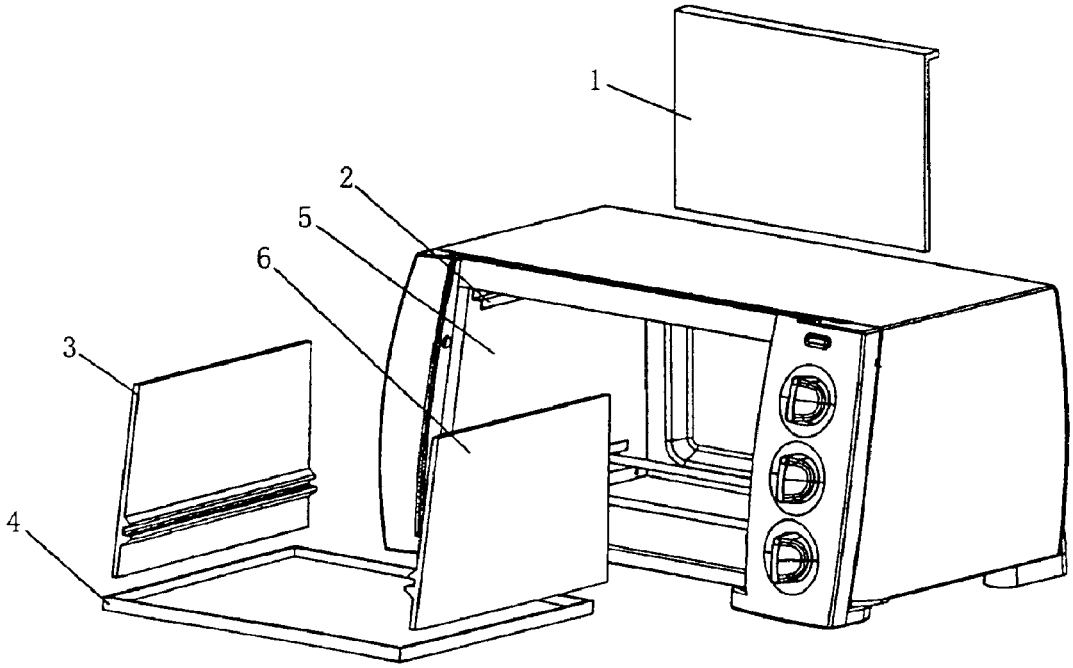
FIG. 3 is a schematic view showing the non-working status of the electric oven after the detachable liners are extracted.

As shown in the FIG. 1*a*, 1*b*, 2, 3, the electric oven of the present invention is constructed by adding detachable liners to the existing electric oven. Said detachable liners are made of stainless steel or covered with non-stick coatings.

Said detachable liners include one left-side liner 3, one right-side liner 6, one lower liner 4 and one back liner 1. If necessary, one upper liner may be further included. A pair of guiding rails 2 are installed respectively on the left and right side board 5 of the inner chamber of the electric oven for guiding the movement of the left-side and right-side detachable liners. The left-side and right-side detachable liners are inserted and extracted along said guiding rails 2.

On said left-side and right-side detachable liners are further installed guiding grooves for supporting said baking rack. Said baking rack can be inserted into or extracted from said electric oven along said guiding grooves.

Said lower detachable liner 4 is pan shaped and installed on the bottom of the inner chamber of said electric oven. Said lower detacher liner 4 is used as the residue collecting pan as well.

Said back detachable liner 1 is installed at the inner side of the back board of the electric oven by guiding rails secured on the inner chamber of said electric oven. There is an opening at the upper side of the back board of the electric oven for allowing said back detachable liner 1 to be inserted into or extracted from said electric oven along said guiding rails.

For the electric oven without an upper electric heater, said upper detachable liner is installed at the inner side of the upper board of the electric oven by guiding rails secured on the inner chamber of said electric oven, and can be inserted into or extracted from said electric oven along said guiding rails. For the electric oven with an upper electric heater secured to the electric oven by porcelain seats, said upper detachable liner is installed directly on said porcelain seats.

What is claimed is:

1. An electric oven with detachable liners includes a front door, a control panel and a rear shell; inside the rear shell is an inner chamber where an electric heater and a baking rack are installed; said electric oven further includes detachable liners; wherein, said detachable liners include a detachable left-side liner and a detachable right-side liner, said detachable left-side and right-side liners are in the shape of plane plate, and are installed respectively at the left and right inner side board of the electric oven by guiding means secured on the inner chamber of said electric oven; said detachable left-side and right-side liners can be inserted into or extracted from said electric oven along said guiding means respectively; said detachable liners further include a back detachable liner; said back detachable liner is in the shape of plane plate; said back detachable liner is installed at the inner side of the back board of the electric oven by guiding means secured on the inner chamber of said electric oven; there is an opening at the upper side of the back board of the electric oven for allowing said back detachable liner to be inserted into or extracted from said electric oven along said guiding means.

2. An electric oven with detachable liners includes a front door, a control panel and a rear shell; inside the rear shell is an inner chamber where an electric heater and a baking rack are installed; said electric oven further includes detachable liners; wherein, said detachable liners include a detachable left-side liner and a detachable right-side liner, said detachable left-side and right-side liners are in the shape of plane plate, and are installed respectively at the left and right inner side board of the electric oven by guiding means secured on the inner chamber of said electric oven; said detachable left-side and right-side liners can be inserted into or extracted from said electric oven along said guiding means respectively; said detachable liners further include an upper detachable liner; said upper detachable liner is in the shape of plane plate; said upper detachable liner is installed at the inner side of the upper board of the electric oven by guiding means secured on the inner chamber of said electric oven, and can be inserted into or extracted from said electric oven along said guiding means.

3. An electric oven with detachable liners includes a front door, a control panel and a rear shell; inside the rear shell is an inner chamber where an electric heater and a baking rack are installed; said electric oven further includes detachable liners; wherein, said detachable liners include a detachable left-side liner and a detachable right-side liner, said detachable left-side and right-side liners are in the shape of plane plate, and are installed respectively at the left and right inner side board of the electric oven by guiding means secured on the inner chamber of said electric oven; said detachable left-side and right-side liners can be inserted into or extracted from said electric oven along said guiding means respectively; said detachable liners further include an upper detachable liner; said upper detachable liner is in the shape of plane plate; said electric oven further includes an upper electric heater secured to the electric oven by porcelain seats, said upper detachable liner is installed directly on said porcelain seats.

* * * * *